United States Patent [19]

Reifers

[11] 4,081,123

[45] Mar. 28, 1978

[54] DUAL BASIS WEIGHT MULTI-WALLED EGG CARTON END CELLS

[75] Inventor: Richard F. Reifers, New Canaan, Conn.

[73] Assignee: Diamond International Corporation, New York, N.Y.

[21] Appl. No.: 779,634

[22] Filed: Mar. 21, 1977

Related U.S. Application Data

[63] Continuation of Ser. No. 465,434, Apr. 29, 1974.

[51] Int. Cl.[2] ..... B65D 1/36; B65D 5/66

[52] U.S. Cl. ..... 229/2.5 EC; 229/44 EC; 229/29 M

[58] Field of Search ..... 229/2.5 EC, 44, 45, 229/29 M

[56] References Cited

U.S. PATENT DOCUMENTS

| | | | |
|---|---|---|---|
| 3,128,932 | 4/1964 | Reifers | 229/2.5 EC |
| 3,185,370 | 5/1965 | Reifers et al. | 229/2.5 EC |
| 3,233,812 | 2/1966 | Kennedy | 229/2.5 EC |
| 3,234,077 | 2/1966 | Reifers et al. | 229/2.5 X EC |
| 3,648,916 | 3/1972 | Commiso | 229/2.5 EC |

*Primary Examiner*—Davis T. Moorhead
*Attorney, Agent, or Firm*—Karl W. Flocks

[57] ABSTRACT

A dual basis weight carton of molded construction of pulp, foam or equivalent material comprising an article retaining cellular tray, a cover element and a lock flap element being in integrally hinged relationship with said cellular tray. The said carton being further characterized in that said cover element and said lock flap element are of a higher basis weight than said cellular tray; said cellular tray being of a lower basis weight except in the areas in which said cover element and said lock flap element are hinged to said cellular tray, in the area of the side wall of the upper ends of the cellular tray at each end of the carton, in the area of horizontally extending flanges at each end of said carton, and in the area of denesting ledges at each end of said carton, all of which are of a higher basis weight.

1 Claim, 14 Drawing Figures

DUAL BASIS WEIGHT MULTI-WALLED EGG CARTON END CELLS

This is a Continuation Application of applicant's copending application Ser. No. 465,434, filed Apr. 29, 1974.

BACKGROUND OF THE INVENTION

1. Field of the Invention

The field of the invention is believed to be exemplified by art which may be found in Class 229, subclass 2.5.

2. Description of the Prior Art

Dual weight basis cartons are known and have been in use for a number of years. Prior to the present invention applicant, himself, has been granted U.S. Pat. No. 3,128,932, which relates to cartons of the type which applicant now seeks patent protection for improvements thereover. Applicant's prior patent relates to an egg carton of molded construction of pulp, foam or equivalent material in which the cover member is of generally standard basis weight and the cellular tray member is of a uniformly lesser effective thickness and weight per square inch than that of the cover member.

Although the carton according to applicant's prior patent has been successfully manufactured, the process used left objectionable pock marks on the product and detracted from the appearance. Applicant has made improvements thereon that do not depend upon the process above and have an improved appearance and performance.

SUMMARY OF THE INVENTION

The present invention relates to molded egg carton construction and more particularly to a new and improved molded egg carton construction of pulp, foam or equivalent material of dual basis weight. Consistent with the objects of applicant's prior patent, noted above, the present invention has been developed to produce a molded article with a cellular tray having a large unit area of an apparent uniform thickness, but actually with some variation in thickness and that is generally much lighter in weight than other areas of the product such as in the areas of the cover and lock flap.

Another object of the present invention is to provide a molded article that has improved denesting characteristics.

A further object of the present invention is to provide a molded article having a shorter stacking interval.

Still another object of the present invention is to provide a molded carton with an improved appearance and better visual appeal.

Still a further object of the present invention is to produce a carton of improved quality and performance at a reduced cost.

With the above objects in mind applicant has developed an improved molded egg carton of pulp, foam or equivalent material with dual basis weight which essentially comprises a cellular tray for receiving and retaining therein eggs or like articles, and cover and lock flap elements integrally hinged to upper rear and front wall portions, respectively, of the tray. The carton according to the present invention is generally similar to that which is shown in FIG. 1 of applicant's prior U.S. Pat. No. 100,409 mentioned above in which the cover and lock flap members are shown to be of a higher basis weight and a cellular tray portion of lower basis weight. The carton according to the present invention, however, differs from that of the prior patent in that the new carton includes an egg receiving cellular tray which is generally of reduced basis weight compared to the cover and flap members hinged thereto and additionally horizontally extending end flanges and side walls of the upper ends of the cellular tray at each end of the carton and the areas at which the cover and lock flap members are integrally hinged to the cellular tray, are all of higher basis weight, that is of the same basis weight as the cover and lock flap members in contrast to the carton of the prior patent.

According to the present invention the cover and lock flap members of the carton are made of a higher basis weight. The cover, because of its planar side walls, and because of its lack of multicellular configuration is relatively weak in relation to its unit area, particularly when considered with respect to any vertical loading to which it may be subjected. For the foregoing reason it is important that the side walls of the cover be maintained at a relatively higher basis weight than the side walls of the cellular tray, which because of the cellular construction is inherently endowed with a greater capacity to withstand vertical loading of loaded cartons, for example. Further since the top of the cover is planar, it is necessary that it be maintained at a relatively heavier weight so that it will better retain its uniformly smooth shape even under the heavy load of the rigid cells of the carton packed thereover. Additionally, according to this invention the cover and flap may be made at a weight slightly higher than the same carton produced at the same total weight but at a single basis weight to further enhance performance of the carton in terms of cover stability.

The lock flap is made of a higher basis weight in order that it may provide additional rigidity and support for the cover under vertical load in particular to maintain rigidity during shipment so that is does not become damaged, deformed or bent under storage condition where cartons are stacked as high as twenty feet. Further the lock flap is made so that it is sufficiently rigid to work properly in various types of closing equipment.

The cellular tray, because it is molded at the reduced basis weight compared to the cover obviously effects a substantial saving of material and energy used in the manufacture of the carton. In this connection it is noted that up to approximately 30% reduction in basis weight has been effected in the manufacture of cartons in accordance with the present invention. Other advantages of the reduced basis weight cellular tray are obtained in greater flexibility in the side walls which provide gentle support of the eggs at all contact points. The greater flexibility of the cellular tray, especially the posts, provides greater control of the smaller eggs because bubble indents are removed on the posts of the carton, while at the same time providing greater control of the larger size eggs which results in greater total egg protection. Bubble indents are formed only on the ends of the carbon itself because the ends are molded heavier and thicker and are not as flexible. Also, in some instances additional flexibility may be imparted to some of the pillopost elements by molding some of the pillopost element walls with sections of additionally reduced thickness. An important advantage of the additional flexibility in the post elements resides in the fact that small eggs placed in the cells will be adequately maintained against movement therein while better accommodation for large and extra large eggs is afforded due to the fact that the post elements will flex more easily than in previous cartons.

Still further flexibility can be given the posts of the carton when it is made of molded pulp by molding bubbles into the preform and pressing the bubbles out in the final hot pressing of the carton which results in posts without bubbles but with greater flexibility to the egg because of the "memory" of the original bubble molded into the preform.

Additionally, the thin cell walls afford closer nesting of the cartons and smoother finish on both sides of the carton, whereby cartons are denested more easily to provide greater reliability when the cartons are used with high speed automatic denesting egg carton loading and closing equipment. Also, because a smoother finish provided, better printing is achieved to provide a more attractive packaging. As stated above, the cellular tray is generally of reduced basis weight. However, an important exception of the reduced basis weight in the cellular tray is provided at each end of the carton where the side walls of the upper ends of the cellular tray are made at the higher basis weight or thickness, that is at the same weight or thickness of the cover member. The side walls of the upper ends of the cell at each end of the carton are maintained at the higher basis weight in order to provide a rigid force transfer zone from the end section of the cover to the end flange section of the cells which in turn transfer the vertical load force into the end cell walls.

Additionally, horizontal end flanges of the cellular tray are maintained at a higher basis weight so that they are heavier than the major portions of the cellular tray in order to provide adequate strength and rigidity as the carton is supported at this area in denesting equipment. Additionally, with the end flanges maintained at the higher weight they will be more stable in shipping and storage conditions and will provide added protection to the eggs against horizontal impact forces against the flange in rough handling conditions.

BRIEF DESCRIPTION OF THE DRAWINGS

In the accompanying drawings in which there is illustrated one complete embodiment of a preferred form of the invention.

DETAILED DESCRIPTION OF SPECIFIC EMBODIMENT

Figure 1:
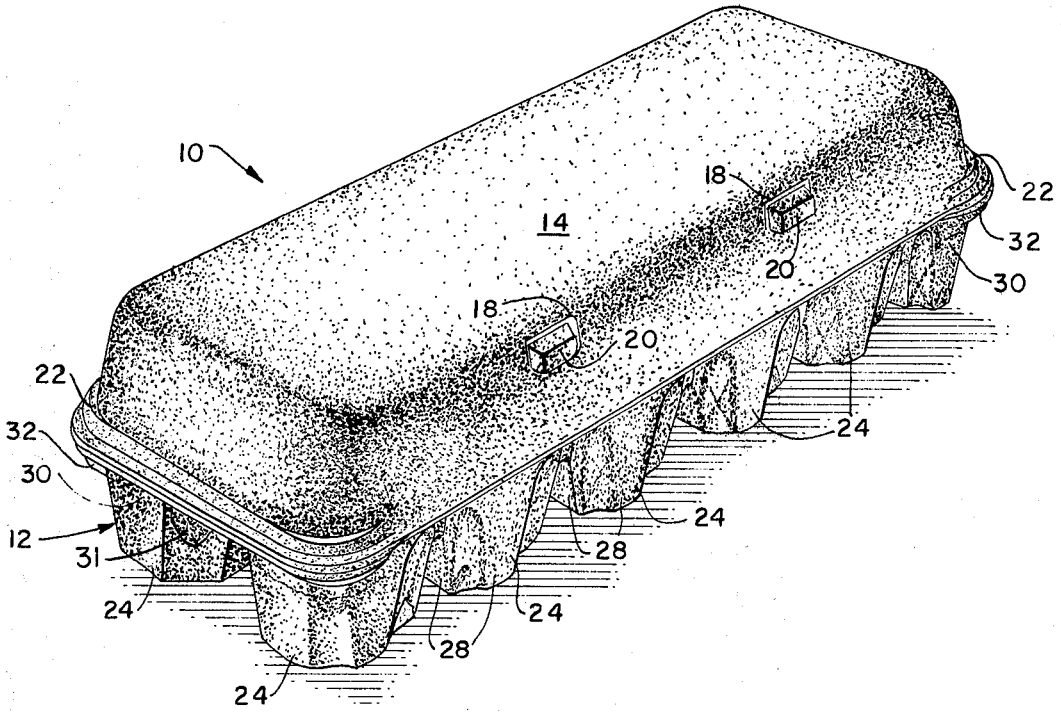
FIG. 1 is a view in perspective of the carton according to the present invention with the cover in closed condition.

Referring now particularly to FIGS. 1–4, the carton 10 according to the present invention may be seen to comprise a cellular tray 12 of molded pulp, form or equivalent material, a lid or cover 14, and a lock flap 16. The lid or cover 14 and the lock flap 16 extend from opposite edges of the cellular tray 12 along integral hinges 15 and 17, respectively. A pair of longitudinally spaced apertures 18 are provided along a front wall portion of the cover 14. The lock flap 16 is provided with a pair of projecting buttons 20 which register with and extend through the apertures 18 to lock the cover 14 when it is closed over the lock flap 16.

Figure 2:
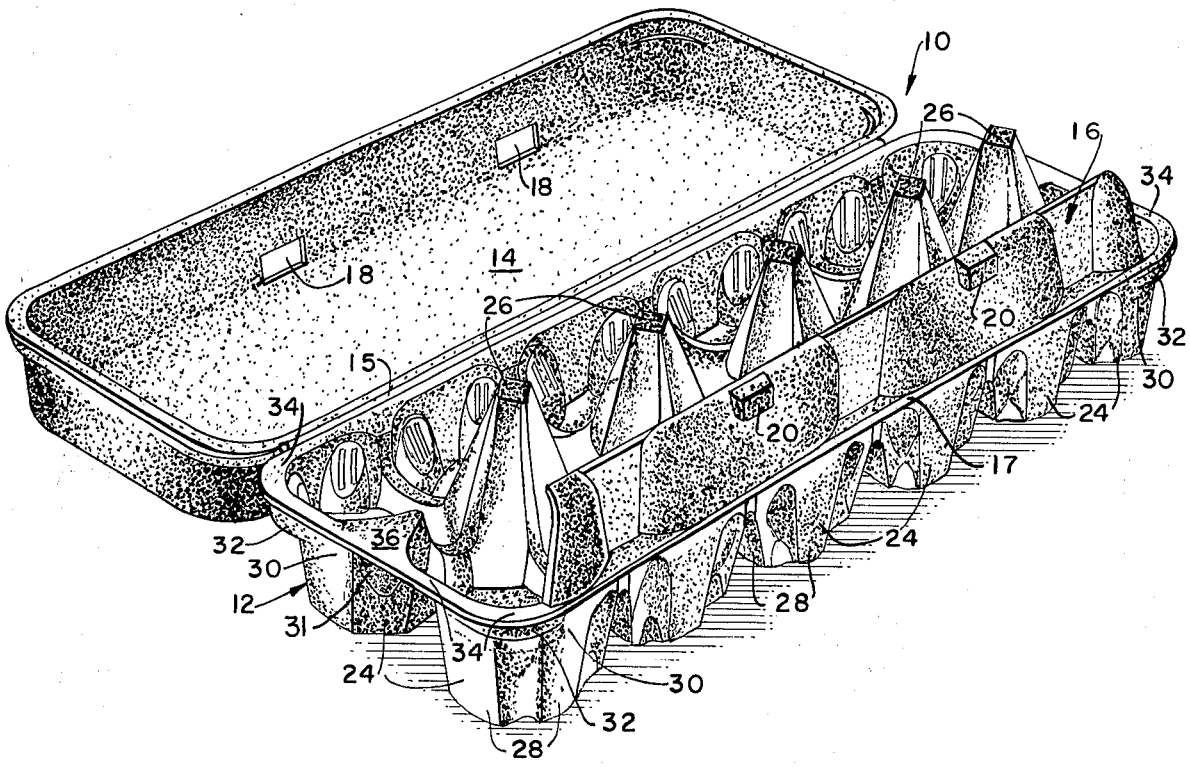
FIG. 2 is a view in perspective of the carton of FIG. 1 with the cover in opened condition.
Figure 3:
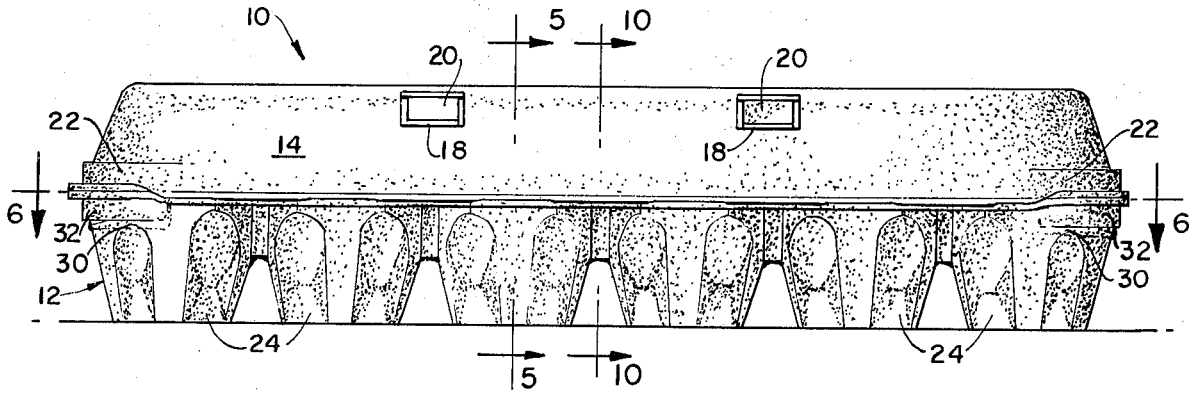
FIG. 3 is a front elevational view of the carton of FIG. 1.
Figure 4:
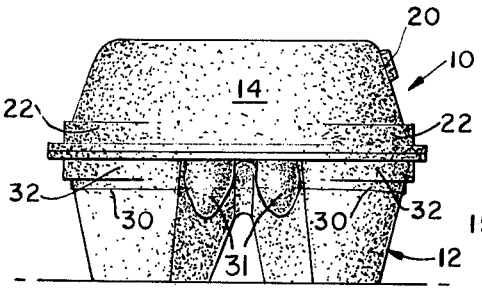
FIG. 4 is a side elevation view of the carton of FIG. 1.
Figure 5:
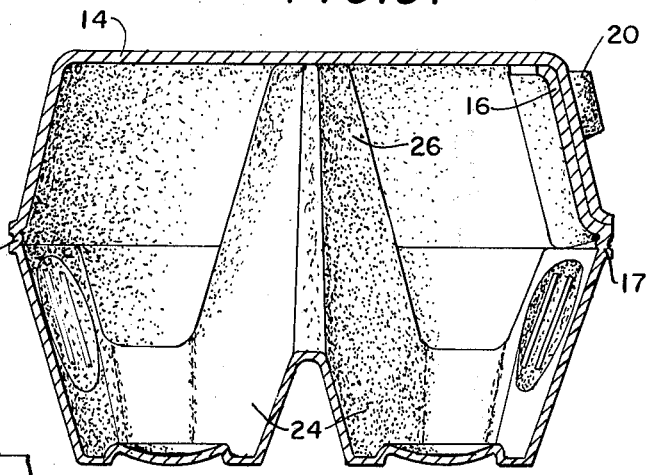
FIG. 5 is an enlarged sectional view taken along the plane 5—5 of FIG. 3.
Figure 6:
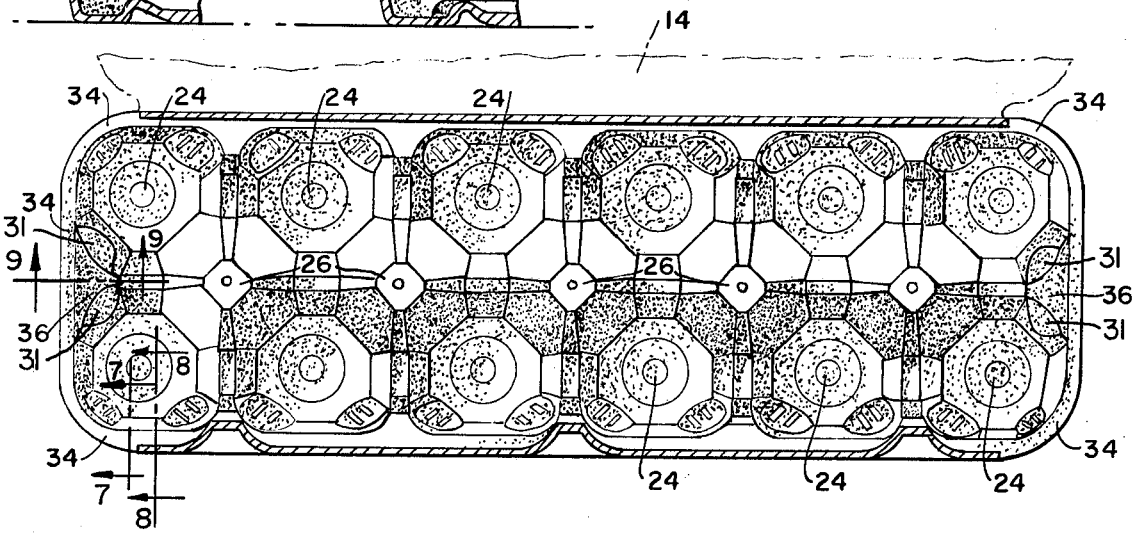
FIG. 6 is a sectional view taken along the plane 6—6 in FIG. 3.

Looking now at FIGS. 2 and 6 the cellular tray 12 is seen to comprise a plurality of cells 24 into which eggs may be inserted and packaged for shipment and sale. The cells 24 are arranged in two longitudinally extending rows and further in sets of four around a pillopost element 26 which extend up from the bottom of tray 12. Each cell 24 comprises a plurality of ribbed wall portions 28. Each pair of end cells 24 comprise upper wall portions 30 extending for about 180° therearound, which together would appear generally in the form of the letter W on a horizontal plane passed therethrough. Bubble indent portions 31 are formed in the end walls of tray 12 at upper wall portions 30 and impart rigidity to the tray 12. Also formed on the upper wall portions 30 of end cells 24 are denesting ledges 32 formed along the upper edge thereof. Integral with the upper wall portions 30 of the end cells 24 and extending in a horizontal plane are horizontal flanges 34 which are generally in the shape of the letter W of which the center portion is generally triangular in shape.

Looking now at FIGS. 5, 7–10, and 12 it may be seen that certain parts of the carton 10 are shown to be of grrater thickness, and therefore of greater weight, than other parts thereof. To more specifically locate the areas of differing thicknesses or weight reference may be made to FIGS. 6 and 12. In connection with the present invention it is to be understood that the areas shown in section to be of greater thickness represent areaw which are of higher or standard basis weight insofar as egg cartons are concerned and the relatively thinner areas represent areas of lower or reduced basis weight, which taken together constitute the basis of the present invention. It is to be further understood that while the areas of the carton illustrated as having relatively greater thickness represent areas having higher basis weight, such areas might instead be actually of relatively lesser thickness and yet be areas of a higher basis weight. In this regard, such areas of higher basis weight but of relatively lesser thickness could, for example, be the result of relatively higher degree of localized compacting or concentration of molded material so that such areas constitute strengthened areas of higher density or higher basis weight, but yet of lesser thickness. The cover 14, because of its generally planar unmodulated side walls, is relatively weak in relation to its unit area that is subject to vertical loading and because of this the side walls of the cover are made at a higher basis weight or thickness than the modulated side walls of the cellular tray 12. In this connection it is seen that the cellular tray 12 because of the cellular structure of the cells 24 and the plurality of ribbed wall portions 28 thereof are relatively stronger and have greater capacity to sustain vertical loads, the tray 12 is generally made with reduced basis weight or thickness. The lock flap 16 is also made of a higher basis weight or thickness, as in the case of the cover 14, since it functions as an auxiliary structure to absorb part of the vertical load that the cover 14 would otherwise sustain alone.

Figure 10:
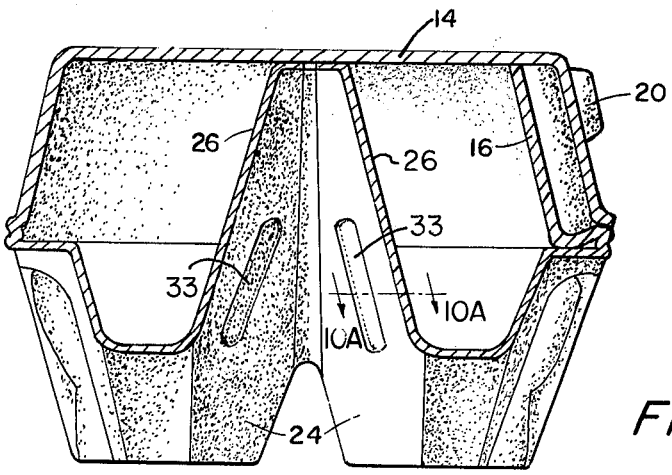
FIG. 10 is an enlarged sectional view taken along the plane 10—10 in FIG. 3.
Figure 10A:
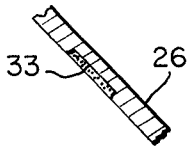
FIG. 10A is a section view taken along the plane 10A—10A in FIG. 10.
Figure 12:
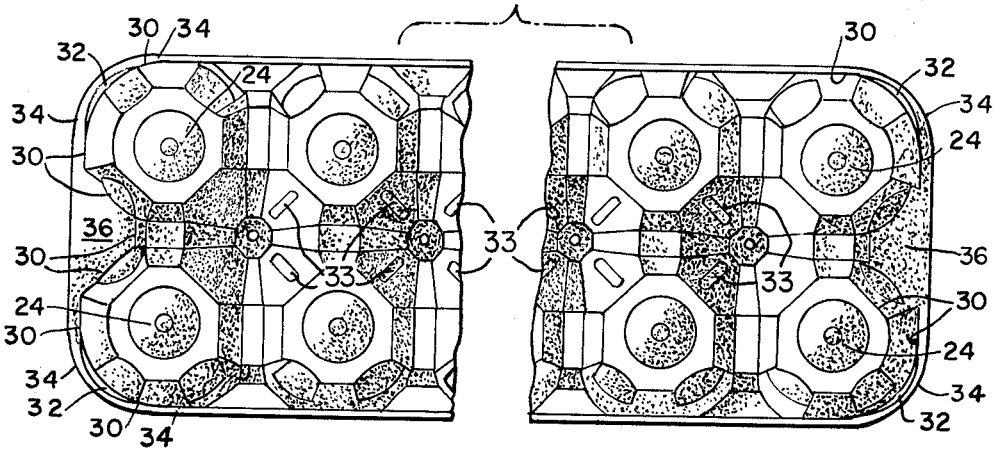
FIG. 12 is a bottom view of the carton illustrated in FIG. 1 with portions broken away.
Figure 13:
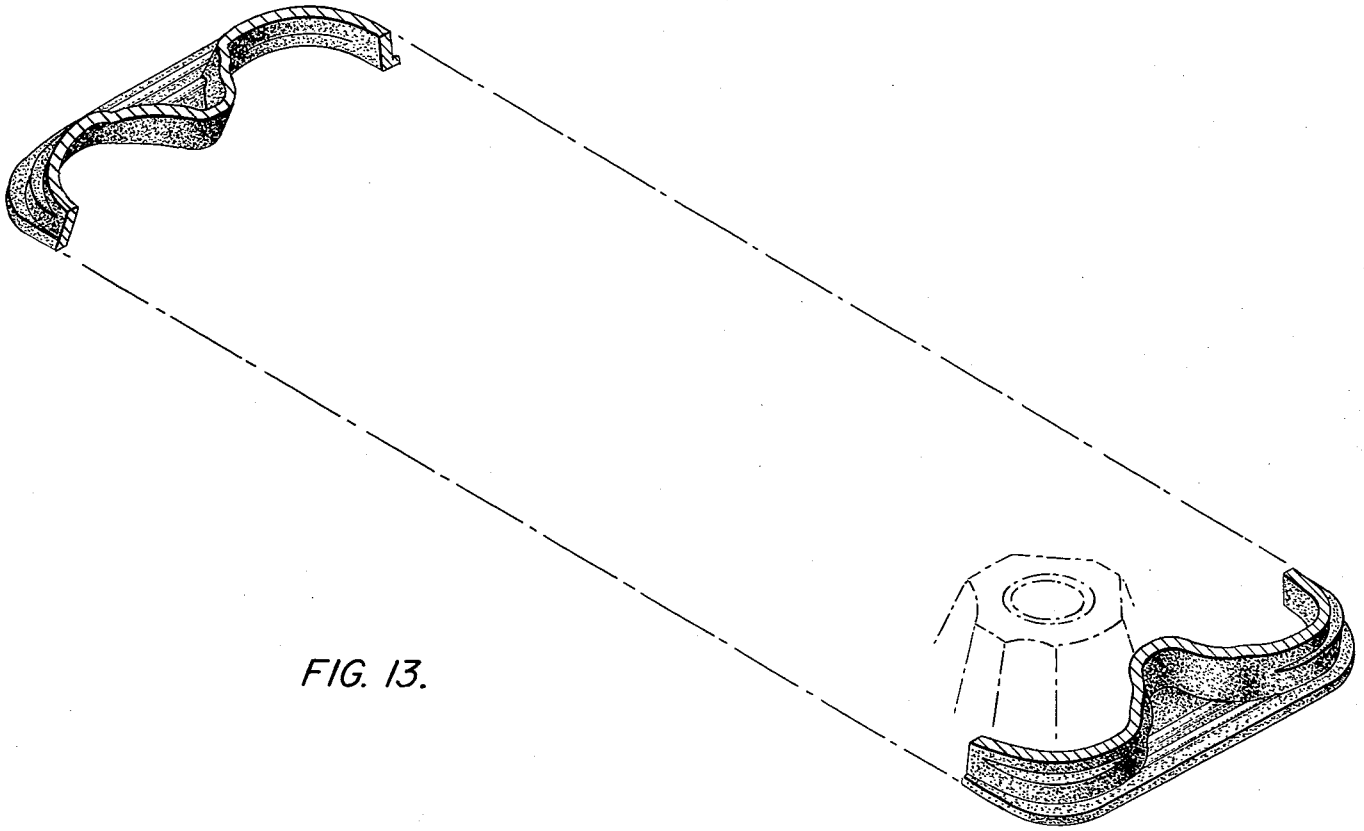
FIG. 13 is a fragmentary view in perspective illustrating the upstanding band-shaped demarked area extending about portions of adjoining end cells with parts broken away as shown by the dot and dash lines.

To impart additional flexibility to cellular tray 12 thinner wall sections 33 may be formed in post elements 26 as best seen in FIGS. 10 and 10A. The thinner wall sections 33 are formed by the use of block out patches in the molding of the tray and as seen in FIG. 12 are formed in each face of the inner posts 26 and only in the inner faces of the end posts 26.

Figure 7:
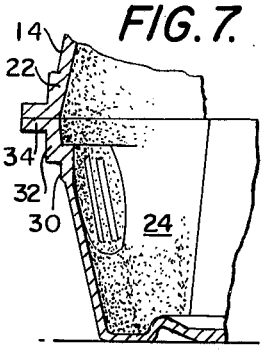
FIG. 7 is an enlarged fragmentary view in section taken along the plane 7—7 in FIG. 6.
Figure 8:
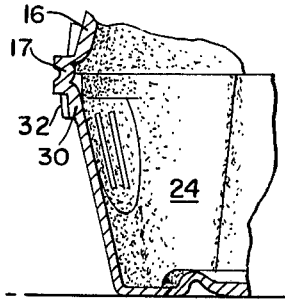
FIG. 8 is an enlarged fragmentary view in section taken along the plane 8—8 in FIG. 6.
Figure 9:
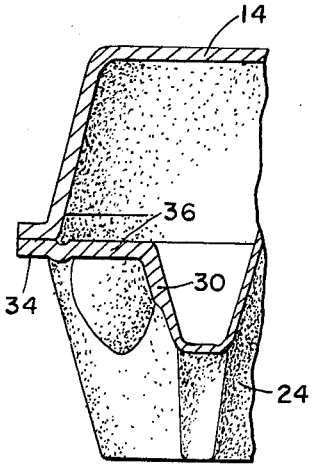
FIG. 9 is an enlarged fragmentary view in section taken along the plane 9—9 in FIG. 6.

The cellular tray 12 is molded at the reduced basis weight or thickness to thus effect a significant saving in material and energy in the manufacture of the cartons. Additionally, side walls are rendered more flexible to provide overall general support of the egg at all contact points. Looking at FIGS. 5 and 10, it may be readily appreciated that the hinges 15 and 17 about which the cover 14 and lock flaps 16, respectively, may be articulated to and from the closed position, are made at a higher basis weight or thickness. The hinges 15 and 17 and the area immediately adjacent thereto are made at a higher basis weight or thickness in view of the fact that they constitute the areas of connection and at least partly serve as a force transfer zone from the cover 14 and the lock flap 16 to the cellular tray 12. Additionally, the upper wall portions 30 of each pair of adjacent end cells 24, as illustrated in FIGS. 7, 8 and 9, are of at least a higher basis weight or thickness in order to provide a rigid force receiving zone in the walls of the end cells 24 so that a rigid force transfer zone is provided in the cellular tray to sustain the vertical load transferred from the end section of the cover 14. The upper wall portions 30 may also be seen from the under side of the carton as extending generally in the shape of the letter W in FIG. 12. Each half of the letter W extends approximately 180° around an end cell 24 associated therewith. Also formed along the upper wall portions 30 are a pair of corner denesting ledges 32 which are of a higher basis weight and increased thickness. Finally, horizontal flanges 34 are formed at a higher basis weight and thickness at opposite ends of the cellular tray 12. The flanges 34 are integral with the upper wall portions 30 and are generally in the shape of the letter W and extend approximately 180° around the periphery of the end cells 24 and include a generally triangular web midportion 36. The end flanges 34 of the cellular tray 12 are made of heavier basis weight and thickness than the rest of the cells so that the carton may be properly supported in denesting equipment in this area and so that the rigidity of this area provides optimum performance. Further, the flanges 34 are made at the higher basis weight so that they will be more stable in shipping and storage conditions and will provide added protection to the egg from horizontal force impact against the flange in rough handling conditions.

Figure 11:
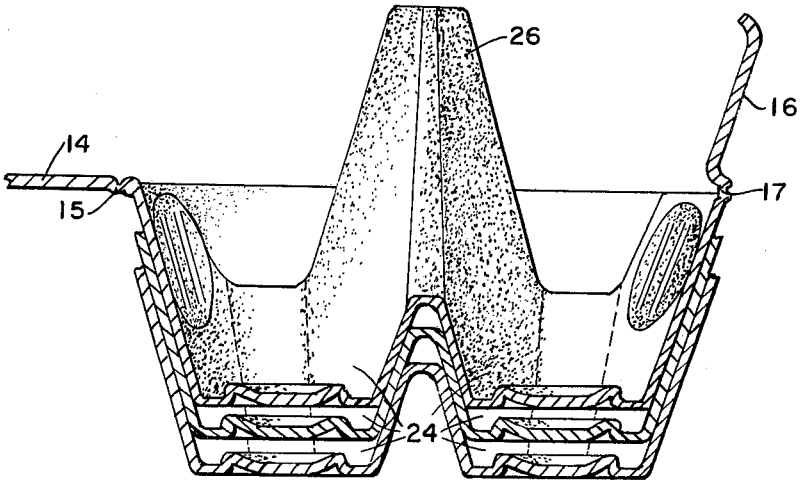
FIG. 11 is a lateral section in elevation of a plurality of cartons according to the present invention to show the nesting relationship of the carton.

It is moreover consistent with the present invention that the cells 24, because of their reduced basis weight or thickness may be molded so that the internal dimensions thereof are the same while the external dimensions are reduced, or internal dimensions can be increased while keeping external dimensions the same. With the foregoing in mind, it will be clear that easier denesting of the cartons from their stacked relationship as illustrated in FIG. 11 would necessarily result.

Although the invention has been described with a certain degree of particularity, it is understood that the present disclosure has been made only by way of example and the numerous changes in details of construction and the combination and arrangement of parts may be resorted to without departing from the spirit and scope of the invention as hereinafter claimed.

I claim:

1. In a molded egg carton having a hinged flap at one long side and a hinged cover at a second long side and two short hinge-free ends and provided with a lower multi-row cellular tray comprising a plurality of cells including two sets of end cells at each of said two short ends and intermediate cells along the carton long sides between said sets of end cells, said end cells being different from said intermediate cells in that each of said end cells has a demarked area of higher basis weight and the corresponding areas of the intermediate cells are of lower basis weight, each of said end cells and each of said intermediate cells having generally upstanding walls with each end cell having a first upstanding wall and a second upstanding wall, said first upstanding end cell walls including all of said demarked area which is in the shape of an upstanding band below the top of said tray and discretely spaced from the tray bottom, said band, like a belt, extending continuously and unbrokenly across and about said first upstanding walls of all of the adjacent end cells at each short end of the carton including, in the demarked area, only the upper portion of the place of juncture thereof where one end cell connects with an adjacent end cell, said upstanding band stopping short of said second upstanding end cell walls which are of lower basis weight, each end cell first upstanding wall having its area, below the demarked area, of lower basis weight, each intermediate cell having its upstanding walls of lower basis weight.

* * * * *